US007179216B2

(12) United States Patent
Klapp et al.

(10) Patent No.: US 7,179,216 B2
(45) Date of Patent: Feb. 20, 2007

(54) CATCH HOOK FOR A FOLDING BOX GLUING MACHINE

(75) Inventors: Hartmut Klapp, Kaarst (DE); Wolfgang Diehr, Grevenbroich (DE); Klaus Naber, Kempen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 90 days.

(21) Appl. No.: 11/119,945

(22) Filed: May 2, 2005

(65) Prior Publication Data

US 2005/0245375 A1 Nov. 3, 2005

(30) Foreign Application Priority Data

Apr. 30, 2004 (DE) ..... 10 2004 021 331

(51) Int. Cl.
*B31B 1/54* (2006.01)
*B31B 3/36* (2006.01)
*B31B 1/36* (2006.01)

(52) U.S. Cl. ..... 493/127; 493/177; 493/310; 493/419

(58) Field of Classification Search ..... 493/51, 493/68, 79, 127, 162, 177, 310, 419, 438, 493/446, 455; *B31B 1/54, 3/36, 1/36*
See application file for complete search history.

(56) References Cited

U.S. PATENT DOCUMENTS 2,857,827 A 10/1958 Labombarde
2,879,699 A 3/1959 Labombarde
2,899,872 A 8/1959 Labombarde
3,388,641 A 6/1968 Gobel
3,672,266 A * 6/1972 Klapp ..... 493/310
3,902,407 A * 9/1975 Trosdorff ..... 493/177
4,105,197 A 8/1978 Pott
4,478,328 A * 10/1984 Heiland ..... 198/485.1
4,544,368 A * 10/1985 Labombarde ..... 493/183

FOREIGN PATENT DOCUMENTS

| | | |
|---|---|---|
| DE | 1 207 778 | 12/1965 |
| DE | 1 211 474 | 2/1966 |
| DE | 1 906 009 | 9/1970 |
| DE | GM 80 19 092 | 10/1980 |
| GB | 1071758 | 6/1967 |

* cited by examiner

*Primary Examiner*—Stephen F. Gerrity
(74) *Attorney, Agent, or Firm*—Laurence A. Greenberg; Werner H. Stemer; Ralph E. Locher

(57) ABSTRACT

An apparatus in a folding box gluing machine has a catch hook mounted such that it can rotate about an axis in order to initiate a leading fold in a product. The apparatus further has a restoring device for the catch hook. The restoring device has at least one elastic element, the axis of the catch hook is connected to the elastic element by a rolling belt.

12 Claims, 5 Drawing Sheets

CATCH HOOK FOR A FOLDING BOX GLUING MACHINE

BACKGROUND OF THE INVENTION

Field of the Invention

The invention relates to an apparatus in a folding box gluing machine having a catch hook mounted such that it can rotate about an axis in order to initiate a leading fold in a product. The apparatus has a restoring device for the catch hook. The restoring device has at least one elastic element.

Typically, apparatuses of the aforementioned type are used to raise sections of a blank about a crease line running transversely with respect to the conveying direction of the machine as the blank passes through the machine, and in this way to initiate a fold.

Apparatuses of this type are disclosed, for example by German Utility Patent DE 80 19 092 U1. The catch hook shown there has a supporting lever which is fixed such that it can be pivoted and to the end of which a hook-like element is fixed with which a leading section of a blank can be pivoted up out of the conveying plane and turned over rearward.

The catch hook is pivoted up by the product itself and, in the process, carries with it the blank moving forward. The necessary forces for introducing the fold are then produced by the thrust of the product. The hook then springs back into its original position, driven by a suitable restoring force which, typically, is applied by a spring which acts on the catch hook. In this case, torsion springs or spiral springs are disclosed by the prior art.

In this case, it should be noted that the blanks can have speeds up to 660 m/min in the running direction and the catch hooks have to be deflected and restored at correspondingly high speeds. In addition, at these high speeds, a large number of alternating loads also accordingly occur, which are reflected in rapid wear of the restoring elements. In addition, because of the high-speed, damage or markings can occur on the blanks as a result of the catch hooks.

Added to this is the fact that, because of the high mass moments of inertia prevailing in these solutions, the speed is limited. If the restoring force is too low, the catch hook is deflected too easily; if the restoring force is too high, it is not deflected easily enough. This likewise leads to problems with regard to the possible speed with which the folding box gluing machine can be operated. The requisite restoring force is generally different from product to product, however, since it depends on the length of the blank moving forward, the material thickness and other parameters. As a result, setting the restoring force is correspondingly problematic and different catch hooks frequently have to be used for different products, which leads to higher costs and time-consuming tool changes.

Accordingly, it is desirable to provide an apparatus that does not have these disadvantages.

SUMMARY OF THE INVENTION

It is accordingly an object of the invention to provide a catch hook which overcomes the above-mentioned disadvantages of the prior art devices of this general type, which can be handled easily, has improved setting possibilities and a longer service life.

With the foregoing and other objects in view there is provided, in accordance with the invention, an apparatus in a folding box gluing machine. The apparatus contains a catch hook having an axis and rotatably mounted about the axis to initiate a leading fold in a product, a rolling belt, and a restoring device for the catch hook. The restoring device has at least one elastic element and the axis of the catch hook is connected to the elastic element by the rolling belt.

Accordingly, in the apparatus according to the invention, the shaft of the catch hook is connected by a rolling belt to the elastic element that effects the restoring force of the catch hook. In this case, the term belt is to be understood to mean a flexible element in which the forces act in the direction of tension. It is also conceivable that the belt itself is elastic and thus represents the elastic element at the same time. However, the elastic element can also be a separate spring, for example a spiral spring. On the other hand, it could also be a rubber-like material connecting with the belt. Furthermore, the belt is advantageously wear-resistant in the region that rolls on the shaft.

According to the invention, the masses that affect the restoring force are advantageously reduced as compared with the prior art, so that the inertia of the system is reduced. By using a belt that converts a linear movement of the elastic element into a rotational movement by its configuration about the shaft, little wear of the interacting parts occurs. As a result, the service life of the catch hook is advantageously improved.

In an advantageous refinement of the inventive apparatus, the restoring device has a setting device for the restoring force of the catch hook. As a result, the catch hook can be acted on with different restoring forces, which meets the requirement to be suitable for different products. For example, the necessary restoring force can be set to parameters which are generally different from product to product, since they depend on the length of the blank moving forward, the material thickness and so on. As a result, in many cases, changing the tool is not required, so that the time for the tool change does not arise and the costs for a plurality of catch hooks are reduced.

In an advantageous development of the apparatus according to the invention, the setting device for the restoring force of the catch hook contains a pre-stressing device with which a specific pre-stress in the elastic element can be set. In particular, the elastic element is a spring of which the fixing point on the apparatus can be displaced in order to produce the desired pre-stress. In this case, the spring could advantageously be a tension spring, of which one end, which is not connected to the belt but to the apparatus, can be displaced.

In a further advantageous development of the apparatus according to the invention, the apparatus contains a damping device by which the restoring movement of the catch hook can be damped. As a result of the restoring force, the catch hook springs back into its initial position in order to be ready for the next product. However, the catch hook can process the next product only when it is actually also in the initial position. By the restoring force, however, the catch hook in the prior art is conveyed into its initial position in such a way that, because of its momentum, it first bounces back once or repeatedly. As a result, the time until the catch hook is ready for the next product is disadvantageously delayed. If, now, a damping device is fitted in the region of the initial position of the catch hook, the catch hook comes back into its initial position more quickly and, accordingly, an increase in the throughput of the folding box gluing machine can be achieved, since the distance between the successive products can be reduced and/or the transport speed can be increased. The damping device is advantageously an engineering rubber buffer. The position of the damping device can advantageously be varied relative to the catch hook.

In a further advantageous development of the apparatus according to the invention, the mounting of the catch hook is such that rotation of the catch hook about its shaft to about 60° to 120°, and in particular about 90°, is possible. As a result, the catch hook is able to process a large number of blanks of different length moving forward. Advantageously, the position of the hook in the longitudinal direction and transport direction can also be changed, so that the position of the catch hook can be chosen freely.

In a further advantageous development of the apparatus according to the invention, the catch hook is fixed to the shaft such that it can be released and rotated about its own longitudinal axis, so that the angle between the catch hook angle and blank running direction can be varied, in particular in a range from −70° to +70°. This is advantageous when folding leading edges that are disposed obliquely, since specific hooks, what are known as window hooks, were previously used in a left-hand and right-hand configuration. This is no longer necessary with the novel form, which increases the flexibility and reduces the changeover times and the number of hook types needed.

In a further advantageous development of the apparatus according to the invention, the apparatus contains a latching clamp, by which the catch hook can be removed permanently from the working plane.

Other features which are considered as characteristic for the invention are set forth in the appended claims.

Although the invention is illustrated and described herein as embodied in a catch hook, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
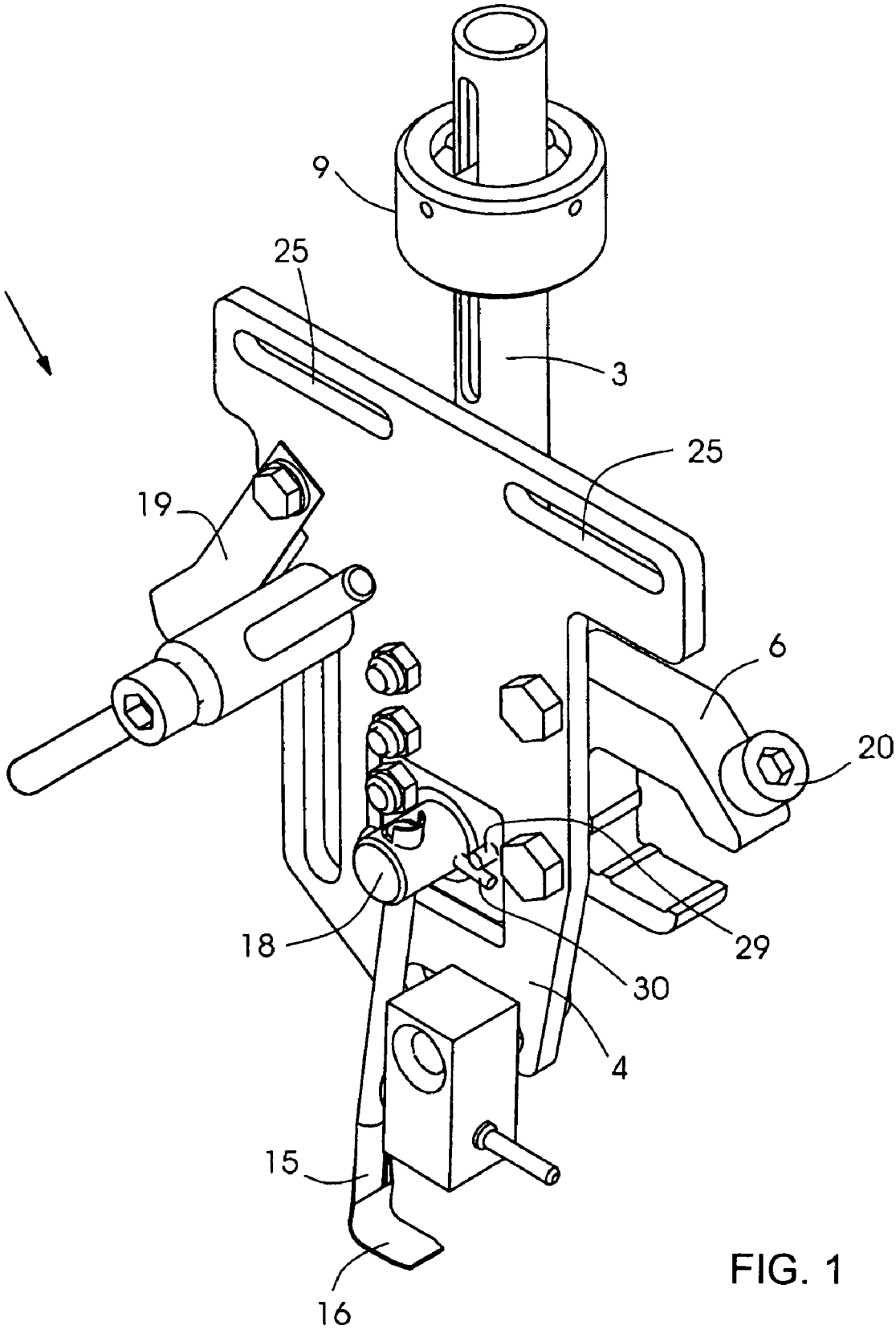
FIG. 1 is a diagrammatic, perspective view of a catch hook apparatus according to the invention.
Figure 2:
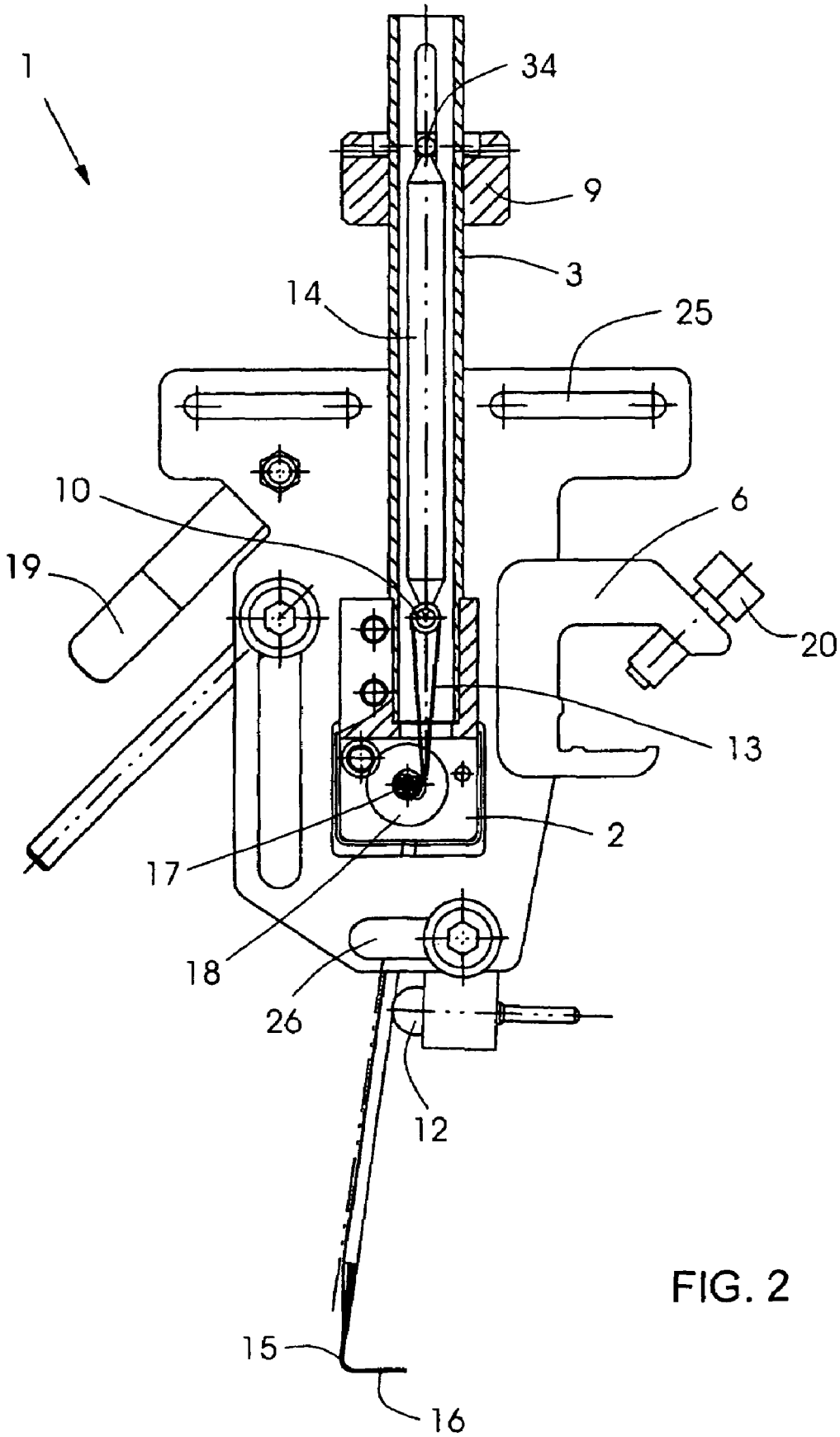
FIG. 2 is a diagrammatic, sectional view of the catch hook.
Figure 3:
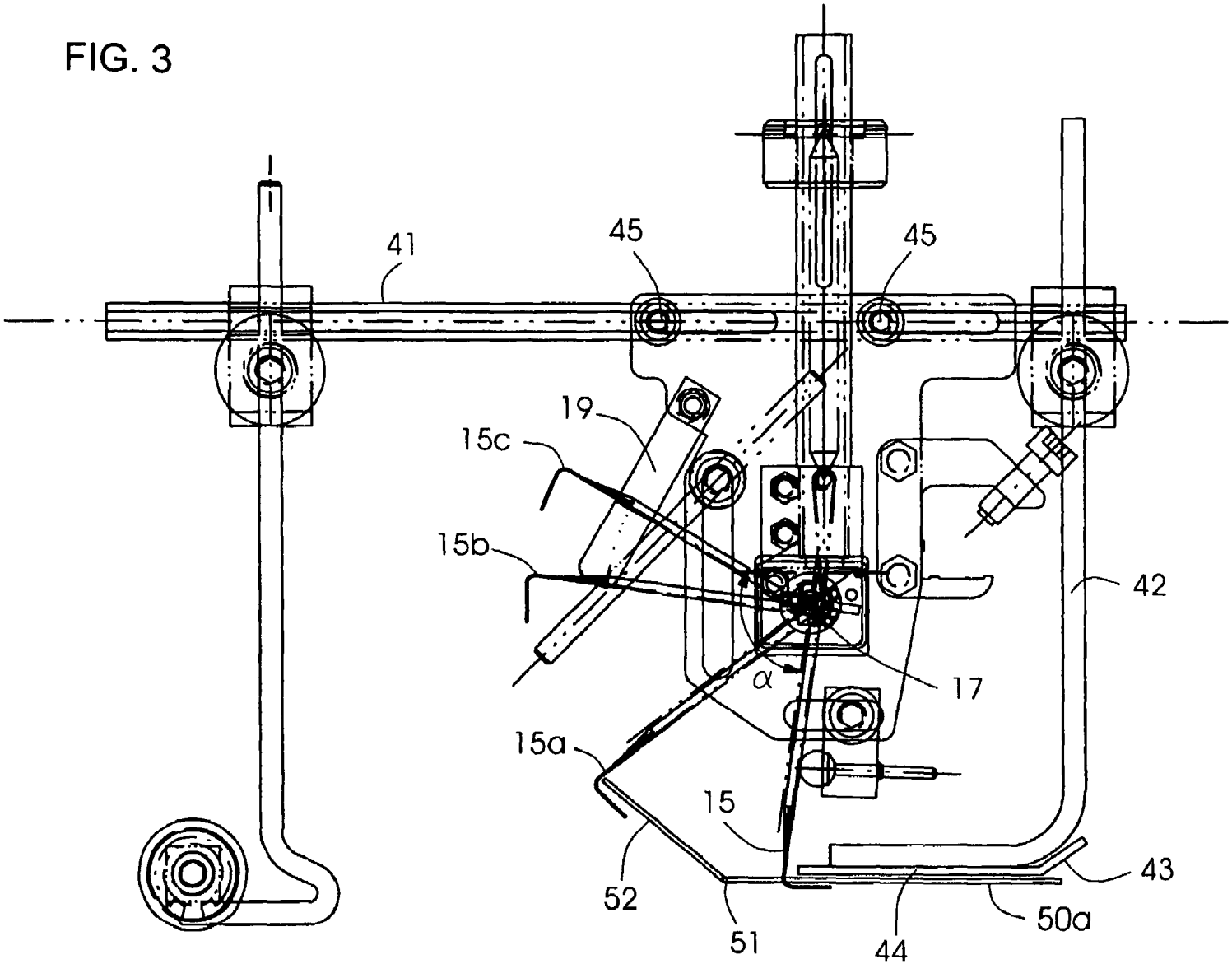
FIG. 3 is a diagrammatic, sectional view of the catch hook in different working positions.

Referring now to the figures of the drawing in detail and first, particularly, to FIGS. 1–3 thereof, there is shown a catch hook apparatus 1 according to the invention. The catch hook apparatus has a catch hook 15 mounted such that it can be pivoted about an axis 17, and a catch hook angle 16. Fitted to a shaft 18, which is disposed about the axis 17, is a pin 30, which interacts with a stop 29 that is fixed to a plate 4, in order to determine the initial position of the catch hook 15.

Additionally fixed to the plate 4 is a tube 3, which ends immediately above a housing 2 of the shaft 18. Disposed within the tube 3 is an elastic element 14, in particular a tension spring 14. The elastic element 14 is fixed at one end to a tensioning pin 34 that is mounted in a tensioning nut 9. By adjusting the tensioning nut 9, the position of a tensioning pin 34 along the tube 3 can be varied. For this purpose, the tensioning nut 9 has depressions disposed in the manner of a star, which prevent automatic displacement on account of the opposing force. In a preferred embodiment, the tensioning nut 9 has a quadrant detent. By displacing the tensioning nut 9, the stress of the elastic element 14 can therefore be varied, so that it is possible to exert an influence on the restoring force of the catch hook 15. As a result, the restoring force of the catch hook 15 can be matched in a simple and convenient manner to the different parameters that are responsible for the necessary magnitude of the restoring force.

The other end of the elastic element is connected to a belt 13. The tube 3 and the elastic element 14 are disposed substantially tangentially with respect to the shaft 18. The other end of the belt 13 is fixed to the circumference of the shaft 18. If the catch hook is deflected out by a product 50*a*, the belt 13 is wrapped around the shaft 18 by this configuration and the elastic element 14 is stretched.

The catch hook 15 has a semicircular cross section on the shaft 18 and is preferably fixed to the latter by a threaded pin. As a result, the height of the catch hook 15 with respect to the working plane can be adjusted, that is to say its active length, and also, as a result of rotation of the catch hook 15, the angle formed by the catch hook angle 16 with respect to the blank moving forward. As a result, the catch hook angle 16 can be set so as to be rotated relative to the running direction of the blank by up to 140°, or from +70° to −70° in both directions. This is advantageous when folding leading edges that are disposed obliquely, since specific hooks, what are known as window hooks, were previously used in a left-hand and right-hand configuration. This is no longer necessary with the novel form, which increases the flexibility and reduces the changeover times and the number of hook types needed.

A damper 12 is fitted in a slot 26 in the plate 4 by a fixing element 23, in particular a screw 23. The damper 12 is preferably an elastomer, in particular an engineering rubber buffer. The damper 12 absorbs the restoring movement of the catch hook 15 when the latter springs back into the initial position as a result of the restoring force which is generated by the elastic element 14.

Figure 4:
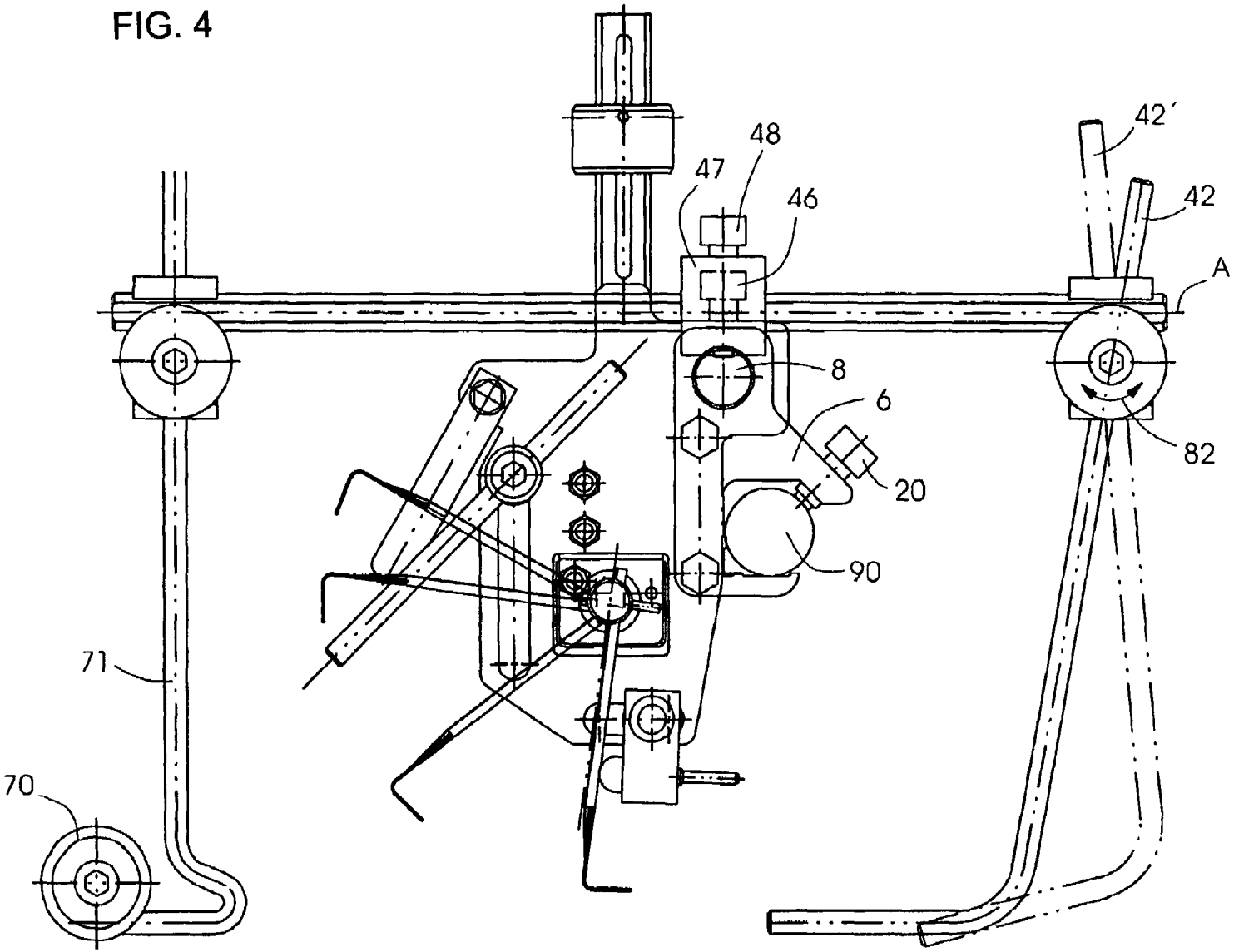
FIG. 4 is a diagrammatic, sectional view of an alternative embodiment of the apparatus according to the invention.
Figure 5:
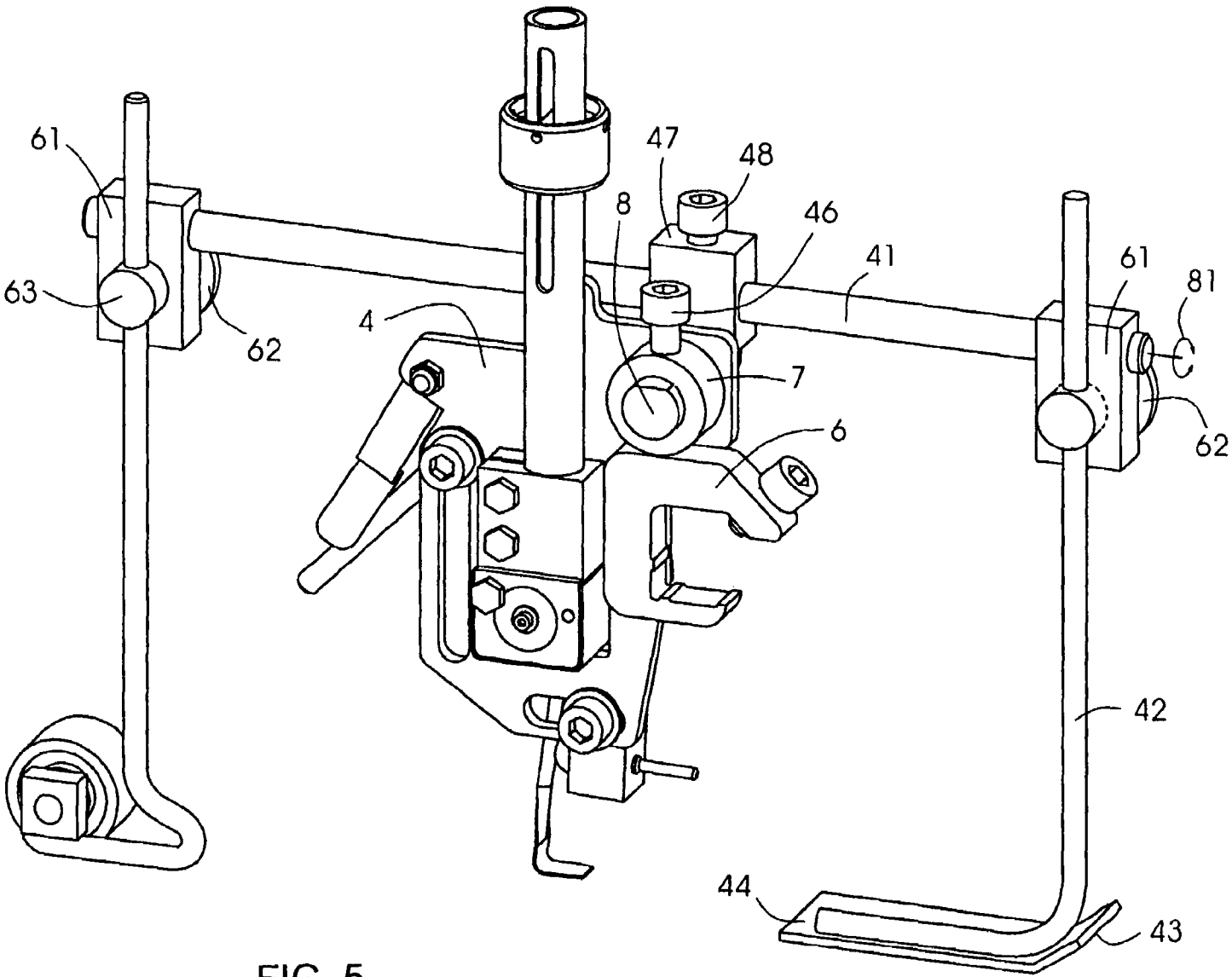
FIG. 5 is a diagrammatic, perspective view of a further alternative embodiment of the apparatus according to the invention.

Also fitted to the plate 4 is a fixing block 6, by which the catch hook apparatus 1 can be fixed to a cross-member 90 (see FIG. 4) by a screw 20 such that it can be displaced longitudinally with respect to the transport direction of a product, in order to adapt the position of the catch hook 15 to the corresponding geometry of a product 50*a*. In addition, the plate 4 has two slots 25, through which a first rod 41 (see FIG. 3) can be fixed to the catch hook apparatus 1 by screws 45. Alternative embodiments of the fixing mechanism are shown in FIGS. 4 and 5. The two embodiments in this case differ substantially in the fact that, in the embodiment in FIG. 5 the holding block 6 is configured in the same way as the holding block 6 of the embodiment of FIGS. 1 to 3 and, in addition, a clamping element 7 is provided in order to fix the rod 41 to the plate 4. On the other hand, in the embodiment in FIG. 4, the holding block 6 is configured in one piece and therefore already contains the clamping element 7 for fixing the rod 41 to the plate 4.

In the clamping element 7, a pin 8 that is flattened on one side can be fixed by a screw 46. The pin 8 is led through the plate 4 and, on the other side, can be connected to a fixing block 47. By the fixing block 47, the position of the rod 41 and therefore of a running surface 44 or of a running wheel 70 can be displaced with respect to the catch hook 15. The rod 41 can be fixed in the fixing block 47 by the screw 48. The distance between the plate 4 and the rod 41 can be varied by displacement along the pin 8. The result is additional setting possibilities in order to be able to match the apparatus optimally to different products.

The first rod 41 is connected to a further, second rod 42 which, at its end, bears a guide surface 44 by which the products 50*a* are led to the catch hook 15. The guide surface 44 is provided with an entry chamfer 43 in the entry region. Depending on the length of the blank 52 moving forward in the transport direction, the catch hook apparatus 1 can be displaced in the transport direction by the screws 45.

All the embodiments of the apparatus shown in FIGS. 1 to 5 have fixing blocks 61 as connecting elements of the rods 41, 42, 71. The fixing block 61 has a hole and a cutout of semicircular cross section. By the cutout of the semicircular cross section, the rod 41 is guided and can be fixed by the fixing disk 62. For this purpose, the rod 41 has a flat, by means of which adjustment of the position of the vertical rods 42, 71 is possible, so that the vertical rods 42, 71 lie in the working plane of the catch hook 15. However, it is also possible to fix the rod 41 in a differing angular position, in which the flat of the rod 41 is, for example, rotated through 180° about the axis of the rod 41. Although the flat is then no longer aligned with the outer surface of the fixing block 61, a possible setting of the vertical rods 42 and 71 about the axis of the rod 41 about the direction of rotation identified by the arrow bearing the designation 81 is possible for this purpose. Therefore, the running wheel 70 and the guide surface 44 can be pivoted laterally away independently of each other out of the working plane of the catch hook 15.

The fixing pin 63 likewise provided with a hole is led through a hole in the fixing block 61. The rod 42 or the rod 71 is led through the hole in the fixing pin 63 and can be fixed with respect to the fixing block 61 by the fixing disk 62. The fixing pin 63 can be rotated freely about its axis when in the unfixed state, so that the possible settings 42, 42' in FIG. 4 are possible, that it is to say for example a variation of the length of the part of the rod 42, 42' protruding downward from the fixing pin 63, and its angular position with respect to the vertical. This variation is identified by the direction of rotation bearing the arrow with the designation 82 in FIG. 4. The same setting possibilities of course also result for the rear vertical rod 71. As a result, fast and simple adaptation of the catch hook apparatus 1 to different products 50*a* is possible.

During operation, the catch hook 15 is deflected out by a blank 52 of a product 50*a* moving forward and, in the process, is set into a swinging movement about the axis 17. The blank 52 moving forward, which is delimited from the product 50*a* by a crease line 51, is carried along by the catch hook angle 16 and, in the process, bends in at the crease line 51 provided for the purpose. This is shown in FIG. 3 for the catch hook position 15*a*. Depending on the length of the blank 52 moving forward in the transport direction, the catch hook 15 is deflected out to a different extent by a deflection angle about the axis 17, approximately as far as the catch hook position 15*b*. In this case, the angle covered during the process can lie between 30° and 120°; the maximum possible deflection is preferably more than 90°. In the catch hook position 15*c*, the catch hook 15 can be fixed outside the working plane by a latching clamp 19.

If the product is pushed further in the transport direction, shortly after this, the blank 52 moving forward is upright on the catch hook 15, which corresponds to the maximum deflection of the catch hook 15. After that, the blank 52 moving forward comes into contact with the tip of the catch hook angle 16 and is turned over about the crease line 51 in order to prepare the fold. After the catch hook 15 has reached its maximum deflection, the restoring force of the elastic element 14 acts on the catch hook 15 in such a way that the latter assumes its initial position again.

This application claims the priority, under 35 U.S.C. § 119, of German patent application No. 10 2004 021 331.3, filed Apr. 30, 2004; the entire disclosure of the prior application is herewith incorporated by reference.

We claim:

1. An apparatus in a folding box gluing machine, the apparatus comprising:

a catch hook having an axis and rotatably mounted about said axis to initiate a leading fold in a product;

a rolling belt; and a restoring device for said catch hook, said restoring device having at least one elastic element, said axis of said catch hook connected to said elastic element by said rolling belt.

2. The apparatus according to claim 1, wherein said restoring device has a setting device for a restoring force of said catch hook.

3. The apparatus according to claim 2, wherein said setting device for the restoring force of said catch hook includes a pre-tensioning device with which a specific pre-stress can be set in said elastic element.

4. The apparatus according to claim 1, wherein said elastic element is a spring having a fixing point that can be displaced in order to generate a desired pre-stress.

5. The apparatus according to claim 1, further comprising a damping device by which a restoring movement of said catch hook can be damped.

6. The apparatus according to claim 5, wherein said damping device is an engineering rubber buffer.

7. The apparatus according to claim 1, wherein said catch hook is mounted such that rotation of said catch hook about said axis by about 60° to 120° is possible.

8. The apparatus according to claim 7, wherein said catch hook is mounted such that rotation of said catch hook about said axis by 90°, is possible.

9. The apparatus according to claim 1, further comprising a latching clamp by which said catch hook can be removed permanently from a working plane.

10. The apparatus according to claim 1, further comprising a shaft, said catch hook being fixed to said shaft such that said catch hook can be released and rotated about said axis being a longitudinal axis, so that an angle between a catch hook angle and a blank running direction can be varied.

11. The apparatus according to claim 1, further comprising a shaft, said catch hook being fixed to said shaft such that said catch hook can be released and rotated about said axis being a longitudinal axis, so that an angle between a catch hook angle and a blank running direction can be varied in a range from −70° to +70°.

12. A folding box gluing machine, comprising:

a catch hook apparatus containing:

a catch hook having an axis and rotatably mounted about said axis to initiate a leading fold in a product;

a rolling belt; and a restoring device for said catch hook, said restoring device having at least one elastic element, said axis of said catch hook connected to said elastic element by said rolling belt.

* * * * *